United States Patent [19]

Pitts et al.

[11] 4,279,206

[45] Jul. 21, 1981

[54] COAL BURNING SYSTEM

[76] Inventors: Charles D. Pitts; David A. Pitts, both of 3600 High Point Rd., Winston-Salem, N.C. 27107

[21] Appl. No.: 56,411

[22] Filed: Jul. 10, 1979

[51] Int. Cl.[3] ..... F23D 1/00

[52] U.S. Cl. ..... 110/263; 110/215; 110/347

[58] Field of Search ..... 110/263, 264, 265, 347, 110/215

[56] References Cited

U.S. PATENT DOCUMENTS

| | | | |
|---|---|---|---|
| 3,438,722 | 5/1967 | Heridy et al. | 110/215 |
| 3,668,833 | 9/1970 | Cahill, Jr. | 55/121 |
| 4,089,628 | 2/1976 | Blackburn | 110/347 |
| 4,157,889 | 6/1979 | Bonnel | 110/263 |
| 4,173,189 | 12/1977 | Cooper | 110/263 |

*Primary Examiner*—Edward G. Favors

*Attorney, Agent, or Firm*—Charles R. Rhodes; Judith G. Smith

[57] ABSTRACT

Coal is ground or pulverized to an extremely small particle size (6 microns or less) and introduced into a mixing chamber where the coal powder is atomized or mixed with air to form a cloud of coal particles entrained in air. Prescribed, controlled amounts of the coal powder/air mixture are withdrawn from the mixing chamber and fed to the burner nozzle of a furnace, from which nozzle the mixture is directed to a combustion zone. The igniter for the system is positioned at the combustion zone and is preferably a strong electric arc, although other igniters could be used. After combustion exhaust gases from the furnace are withdrawn and cleaned up through a water filter in which a plurality of screens are kept flushed with water passing in one direction as the combustion gases pass in the opposite direction to the atmosphere. The filter water which includes a surfactant therein is then filtered and cleaned up by passing it across marbelized chips where further combustible gases are formed and removed therefrom, which gases may be shunted back into the furnace for reburning.

14 Claims, 6 Drawing Figures

COAL BURNING SYSTEM

BACKGROUND OF THE INVENTION

Many years ago most furnaces and boilers were fired by coal. More recently, as natural gas and oil became more convenient and less expensive, and as home owners and industrial and commercial plant operators realized that gas and oil were cleaner than coal, furnaces and boilers fired by natural gas and oil became more prevalent with the result that up until the last several years coal-fired furnaces and boilers have become more or less obsolete.

Recently, with all the concerns about availability of gas and oil, the increase in price of gas and oil, and the possible and potential administrative restraints over the use of gas and oil, coal has become much more feasible as an alternative fuel for furnaces and boilers. Coal costs are now competitive or perhaps even less expensive than natural gas and oil. Therefore, if the other disadvantages of coal such as convenience, efficiency, and cleanliness can be overcome, coal might become much more attractive as a fuel.

Normally, furnaces or boilers which are fired by coal include a stoker which feeds coal into a box where the coal particles are distributed onto a hot bed of burning coals, rather than feeding the coal through a burner nozzle as is the case with natural gas and oil. Compared to natural gas and oil this is an inefficient burning process because a relatively low percentage of the potential combustible portion of the coal burns, leaving many ashes and clinkers, and also resulting in much smoke and soot because of the relatively low heat effected by a bed of burning coals compared to a burner nozzle.

On the other hand, the relatively high temperature of combustion required to ignite coal makes it hard to burn as it exits rapidly from a nozzle as compared with natural gas and oil. In other words, coal will not ignite as rapidly as other fuels when it exits from a nozzle, because the high temperature of combustion is hard to obtain in a relatively short amount of time by an ignition system. It is known that it is necessary to provide an igniter of either oil or natural gas which provides an ignition temperature in the range of 3500° to 5200° F. in order to get the previously known pulverized coal particles ignited and burning. Such attempts have utilized coal as the primary fuel to be burned in nozzles by reducing the particle size somewhat and igniting a mixture of coal particles and air as the coal particles exit from the nozzle as disclosed in the Graybill U.S. Pat. No. 4,147,116. Utilizing a coal particle size of 40 microns, the particles are maintained in an inner gaseous environment to prevent spontaneous combustion, then delivered through a nozzle which separates the inner gas from the combustible coal particles, whereupon the coal particles are mixed with air which will support combustion and deliver it into a combustion zone past an oil or natural gas igniter. Other attempts have utilized electric arc heated, high velocity, oxidizing gas jets as the igniter for pulverized coal dust. While these attempts may or may not have been successful, the use of secondary petroleum base fuels or other igniter systems are expensive and generally require the use of oil or gas in addition to the coal.

A further disadvantage of coal as a fuel, as set forth hereinabove, is the exhaust gases of combustion resulting from coal are relatively dirty and difficult to clean. This is true because many coal particles and particles of contaminants (fly ash) in coal do not burn with the result that there are so many particles, and some of them fairly large, in exhaust gases that normal filter techniques quickly clog up making the filtration thereof almost impossible. Also, the sulfur gases and other gases remaining in the exhaust fumes of burning coal particles require more than mechanical filters to remove.

Introducing air or other gases which support the combustion of the coal particles near the nozzle where they are mixed with the coal particles does not result in a good homogenous mixture of the coal particles and air at the combustion zone. Further, control of the mixture being provided to the burner is difficult when the air is coming from one point and coal from another. Finally, as is true in all pulverized coal feeding systems, an airborne feed system is difficult to maintain operational because the very small coal particles tend to clog feed lines as coal particles of this size are relatively tacky to the material making up the feed lines.

SUMMARY OF THE PRESENT INVENTION

The present invention, on the other hand, is directed to a system which overcomes all or at least the major problems attendant to the utilization of coal as the primary and sole fuel for furnaces and boilers. The utilization of coal in accordance with the technique of the present invention permits coal to be used as fuel for furnaces using forced air circulation systems because of the cleanliness with which the coal is burned.

In accordance with the general teachings of the present invention, the system in general includes first of all, the utilization of extremely finally ground or pulverized coal, on the order of 6 microns or less, approximately ten times smaller than any previously known coal particle size. The use of such finally ground coal particles serves a dual purpose, first of all to make igniting easier as a lower temperature of combustion is sufficient to ignite the powdered coal, and also provides a higher efficiency of burning, in that substantially 100% of the fuel input is consumed, leaving the exhaust gases extremely free of contaminating particles.

Secondly, the instant invention utilizes a mixing chamber in which the finely ground or pulverized coal particles are introduced to and mixed with a quantity of air. In the mixing chamber, an agitator in the form of a constantly revolving paddle wheel or squirrel cage motor forms a cloud of coal particles entrained in the air. A feed tube having a slot therein extends through the mixing chamber. Air is passed through the feed tube which causes preselected portions of the cloud to be drawn into the feed tube through the slot by the Venturi effect. A slidable cover is provided for the slot to make the slot larger or smaller, which controls the fuel input to the burner nozzle located at the other end of the feed tube. Within the feed tube, a cleaning wiper continuously revolves to insure that the minute particles of coal do not adhere to the sides of the feed tube which would tend to clog the feed tube.

The burner nozzle itself involves a unique development in that it provides for the ignition of the coal particles in a novel and advantageous manner. By way of background, it should be recalled that while attempts may have been made to burn coal particles in a nozzle without any kind of igniter, just by using the previously burning coal itself to ignite the following coal particles, it is not believed that such attempts would have been successful, because coal requires a relatively high combustion temperature which is generally not attained by other burning coal particles. In any event, the nozzle of the present invention includes igniters formed solely of electric arcs. Toward this end, electrodes are spaced axially from the exit end of the nozzle on opposite sides of the path of air and coal as they exit from the nozzle. These electrodes create a combustion zone in the range of 1200°–2400° F. In a preferred embodiment a second set of electrodes are utilized and spaced a little further downstream from the first set of electrodes, also on opposite sides of the path of the air and coal. The first and second sets of electrodes are so arranged with respect to the path of air and coal exiting from the nozzle that the arc therebetween crosses the path. Further, the first and second sets of electrodes are so arranged axially along the path of the air and coal exiting from the nozzle and with respect to each and with respect to the nozzle that the air pressure leaving the nozzle causes the arc between the first set of electrodes to bend downstream the substantially merge with the arc between the second set of electrodes, thereby effecting the combustion temperature into which the powdered coal particles are delivered, making such combustion temperature sufficient to ignite the coal particles and air as they leave the nozzle without any further igniter from a secondary fuel such as natural gas or oil. Further, rather than spreading the distribution of the coal particles into a large area, the nozzle of the present invention includes converging lips to concentrate the coal/air fuel mixture into the combustion zone formed by the electric arcs.

The resulting combustion has provided to be extremely efficient with the result that the interior of the furnace into which the burner flame from the system of the present invention lies is maintained without any ashes, soot, or clinkers forming therein.

To ensure that the exhaust gases exiting to the atmosphere are as clean as possible, the present invention utilizes a unique type of water filter through which the exhaust gases pass, said water filter being self cleaning and requiring relatively little, if any, maintenance. Toward this end, and in general, the exhaust gases from the furnace pass through a plurality of screens being constantly flooded with water containing a surfactant additive therein. The surfactant is for the purpose of ensuring that what few coal particles remain and that are removed from the exhaust gas stream have greater affinity for and remain in suspension in the water, rather than being lodged against or stuck to the walls or screen surfaces of the filters as may well be the case without the surfactant. As the water splashes onto the screen, a film is formed between the interstices of the wire mesh therein so that the air is forced to pass therethrough, and the water with the surfactant included separates the remaining coal particles and sulfur gases and other gases from the exhaust stream. The cleaned exhaust stream passes out the top or exit of the water filter clean enough that it can be breathed without any harmful effects. Further, it is totally invisible and non-contaminating to the atmosphere.

The water which has accumulated the sulfur gases and coal particles remaining in the exhaust gas stream work its way down to a clean up system where it preferably passes through a marble chip filter and is returned to a reservoir from which it is again pumped to the screens. The marble chip filter performs a dual purpose of cleaning the water of contaminants as well as reacting with the sulfur gases therein to give off sulfur dioxide which can be collected and returned to the furnace for burning therein, thereby increasing even further the efficiency of the system.

It is therefore an object of the present invention to provide an improved coal burning furnace system.

It is another object of the present invention to provide a unique coal burning system which is far more efficient than those heretofore known as far as the percentage of coal actually burned.

Another object of the present invention is to provide a unique type of burner nozzle for burning a mixture of coal and air which utilizes an electric arc only.

Still another object of the present invention is to provide a unique filter system for the exhaust gases emitted from a coal-fired furnace, which filter system cleans up to the exhaust gases to such an extent that substantially no contaminants are released to the atmosphere.

Other objects and a fuller understanding of the invention will become apparent after reading the following detailed description of a preferred embodiment in which:

FIGS. 3–5 are schematic representations of the exit end of the nozzle, with the remainder of the nozzle broken away, illustrating the electric arc under conditions of no air coming through the nozzle (FIG. 3), air coming through the nozzle (FIG. 4), and air and fuel being fed through the nozzle (FIG. 5).

DETAILED DESCRIPTION OF A PREFERRED EMBODIMENT

Figure 1:
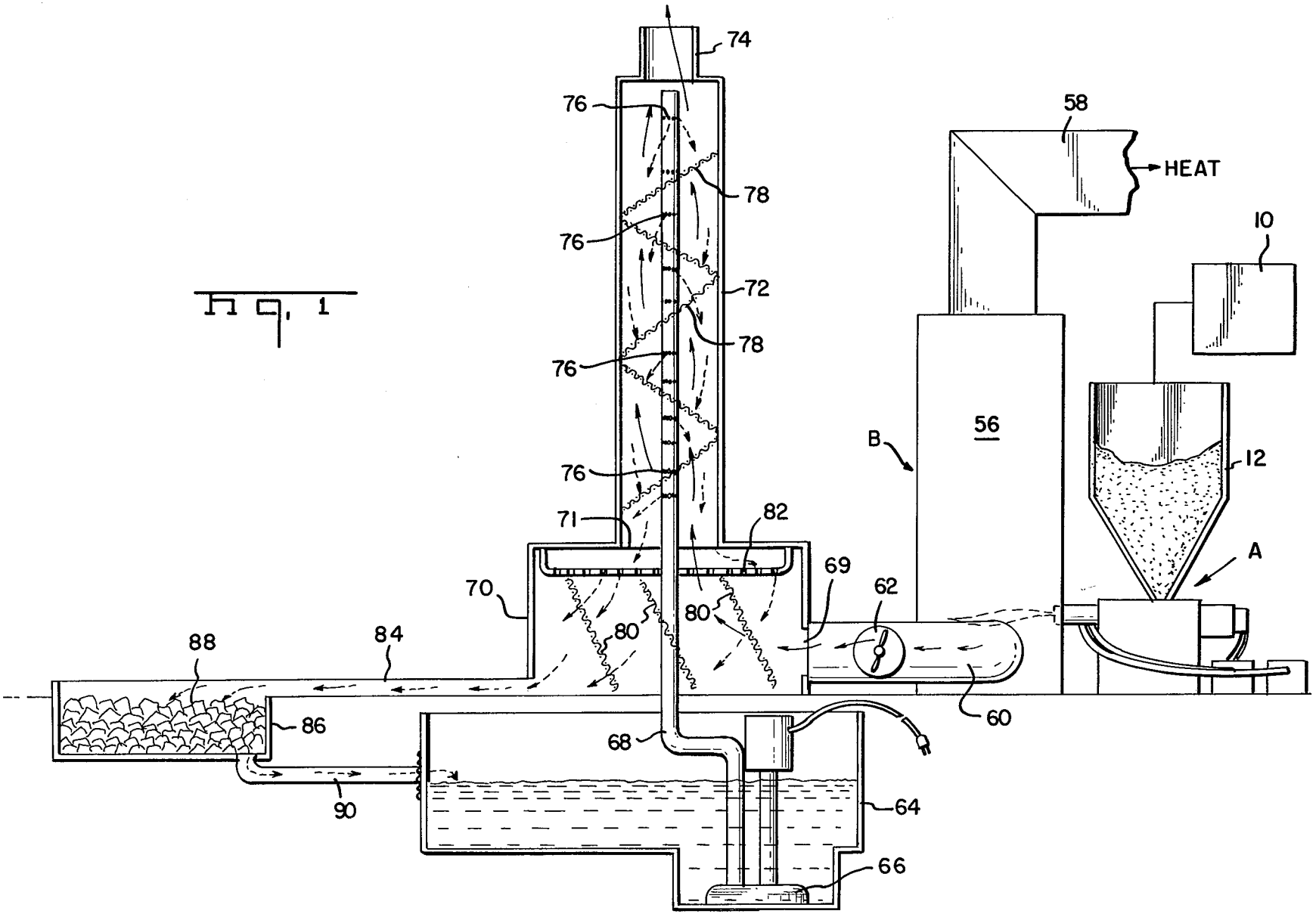
FIG. 1 is a schematic representation, partially in section illustrating the coal-fired furnace system and cleaning filter therefor according to the present invention.

Turning now to the drawings, and as illustrated in FIG. 1, the furnace system in general is divided into three sections: a mixing and feed section A, the furnace section B including the burner nozzle, and the cleaning section C. As previously stated and critical to the invention, the system is utilized with powdered coal particles substantially all of which are of a size on the order of 6 microns or less. The powdered coal particles are first introduced to and mixed with air in the mixing and feed section A to form a cloud of air with powdered coal particles entrained therein. Selected portions of the cloud are withdrawn in the mixing and feed section and delivered to the furnace section B where they are ignited by concentrating and passing the air and coal particle mixture through a combustion zone. The temperature at the combustion zone is elevated above the combustion temperature of the coal particles by an igniting means to be described hereinafter.

Turning now to a description of the mixing and feed section A, first of all coal is pulverized in some type of grinder or pulverizer 10 and formed into powder having a particle size in the range of 6 microns or less. While a minor portion of the powder may have a particle size somewhat larger than 6 microns, most particles will fall in the range of 2–4 microns. After grinding the powdered coal particles are delivered into a hopper or reservoir 12. It should be recognized that the grinder 10 can be located in a separate location or mounted above the hopper 12 without materially departing from the scope of the invention.

From the reservoir 12, the powdered coal is introduced through an inlet 16 in the upper wall 14*a* of the mixing chamber. The mixing chamber is suitably mounted by brackets 15*a*, 15*b* to remain stationary in a prescribed position relative to the furnace section B. An air inlet 18 which extends through the side wall 14*b* of the mixing chamber 14 introduces air from a source under much lower pressure (on the order of one or two pounds per square inch) into the mixing chamber 14. An agitator 20 in the form of a revolving set of blades or squirrel cage motor is continuously turned by a motor mounted to the central axis thereof (not shown), which agitator means keeps the air continuously moving inside mixing chamber 14, so that the finely ground, powdered coal particles become entrained in the air and form a cloud mixture of coal and air.

A feed tube 22 extends through the mixing chamber 14 and includes at the rear end thereof a compressed air inlet 24 which serves to convey air through the feed tube 22 to the outlet end 40 thereof. Other than the air which is introduced to the system through inlets 18,24, in the preferred embodiment, the mixing chamber, feed tube 22, and furnace are kept as air tight as possible. An elongated slot 26 in feed tube 22 at a point where the tube passes through chamber 14 provides a means for introducing selected portions of the cloud of coal particles and air into the feed tube. It should be recognized that the air from input 24 passing continuously through tube 22 will create a Venturi effect at the slot 26 which draws portions of the cloud into the feed tube and delivers them to the converging outlet 40 of the nozzle. A sliding cover 28 having a tab 30 extending radially therefrom is slidably mounted on tube 22 and reciprocated back and forth by means of a threaded rod 32 which extends through a corresponding threaded opening in the tab 30. Rod 32 is operated by means of a knurled knob 34, which in turn is accessible from the outside of mixing chamber; it being understood that the rod 32 extends through the wall of mixing chamber 14 into engagement with tab 30. As the rod 32 is rotated by knob 34, cover 28 is caused to reciprocate back and forth covering up greater or smaller portions of slot 26 so that the amount of the coal/air cloud taken into slot 26 can be precisely controlled.

Figure 6:
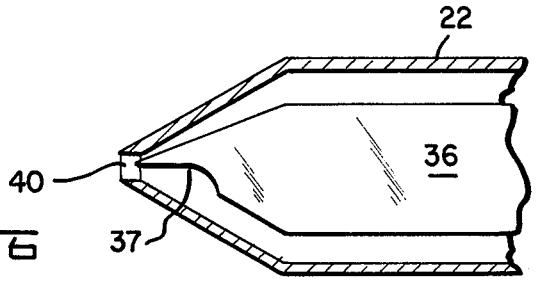
FIG. 6 is an enlarged perspective view, partially in section, illustrating the tip end of the supply tube and the arrangement of the cleaning wiper therein.

A revolving cleaning wiper or blade 36 (FIG. 6) extends through the feed tube 22 and is operated by being connected to the output shaft of a small electric motor 38. As the wiper 36 is of a width substantially the same as the inner diameter of the tube, it keeps the interior of the tube 22 free and minimizes the chances of clogging of the coal particles within the tube. Referring to FIG. 6, the wiper 36 extends all the way to the outlet 40 of the feed tube 22 where it is correspondingly tapered to the walls thereof. A portion 37 is cut away so as not to interfere with the passage of air through the opening 40.

Figure 2:
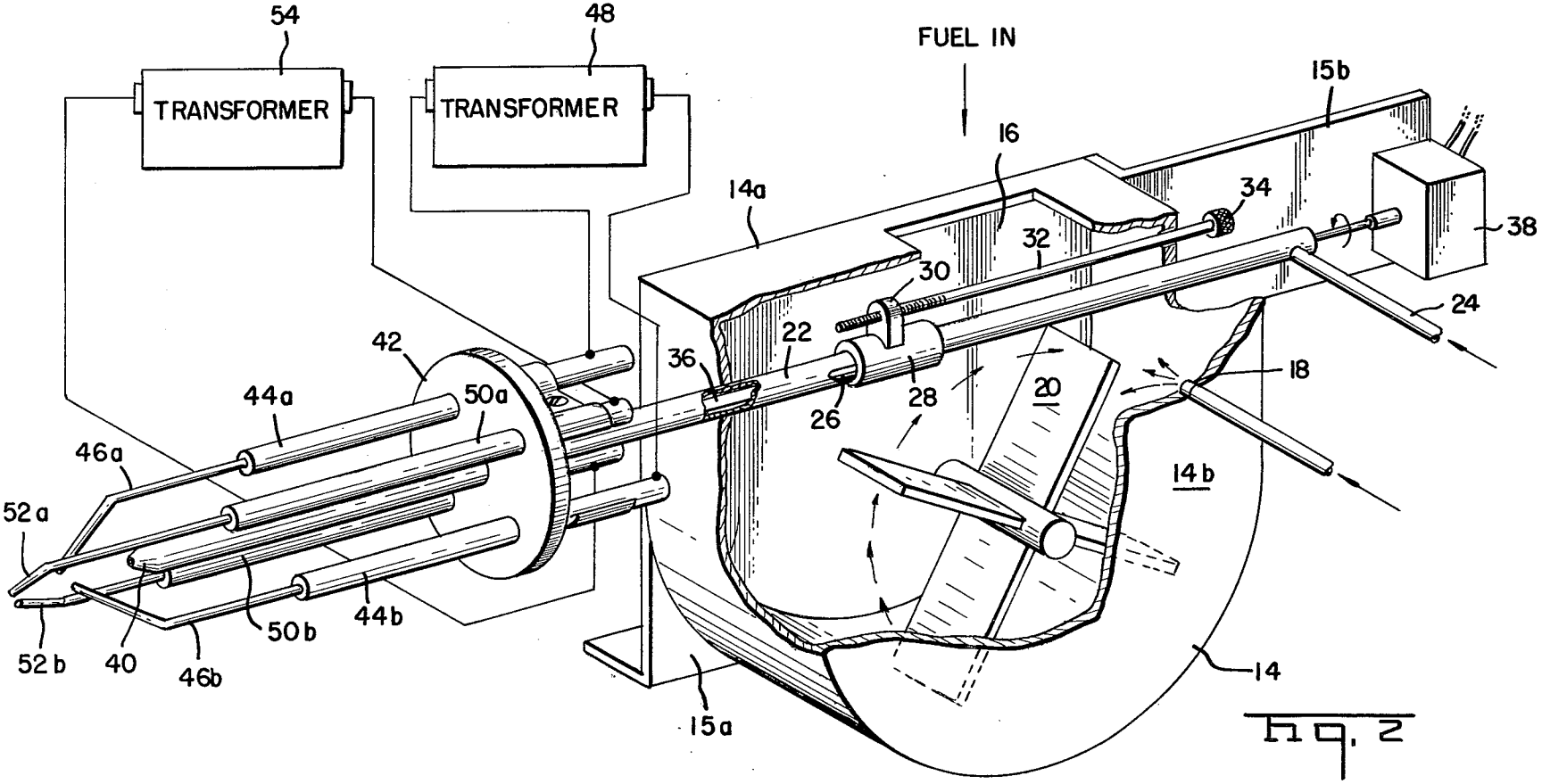
FIG. 2 is a perspective view, with parts broken away, illustrating the mixing chamber, the feed system, and the burner nozzle according to the present invention.
Figure 7:
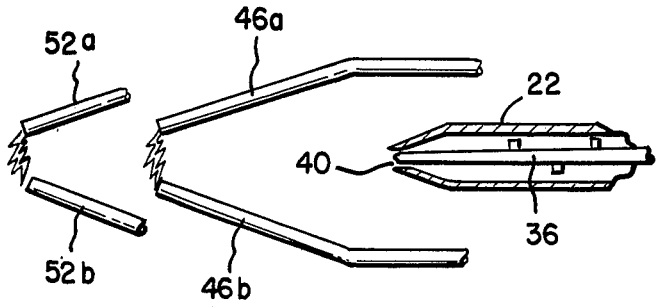

The outlet 40 of feed tube 22 is positioned within the furnace wall, which in FIG. 2 is represented by element 42. As illustrated in FIG. 6, the wall of tube 22 is tapered to converge the stream of coal particles to a size approximating the diameter of a pencil lead. In order to ignite the coal and air mixture exiting from the feed tube 22 at opening 40, in the preferred a first set of electrodes 46*a*, 46*b* are spaced slightly from the exit end 40 of tube 22 and supported in such position by support rods 44*a*, 44*b*. A first transformer 48 is connected across electrodes 46*a*, 46*b* to provide an electric arc between the ends thereof as illustrated in FIG. 3. A second set of electrodes 52*a*, 52*b* are supported by support rods 50*a*, 50*b* in the same manner as described hereinbefore and form a second electric arc when connected to a transformer 54. Operation of the aforementioned nozzle will be described more in detail hereinafter. While one set of electrodes which provides an arc of sufficient magnitude to form a combustion zone temperature in the range of 1200°–2400° F. and of sufficient size to envelope the exiting coal particles, in the preferred embodiment this is accomplished more easily with two sets of electrodes arranged as shown.

The furnace section B, in addition to the aforementioned nozzle includes a fire box 56 having a conduit 58 exiting therefrom which carries heated forced air to other areas of the home, building, or whatever place is being heated. Also it should be recognized that a return air vent should be supplied and the furnace will include some type of heat exchange apparatus, which is conventionally known and does not form a part of this invention. Also, and alternatively, water pipes could be placed within or adjacent the furnace 56 to heat water and form steam. An exhaust duct 60 leads outwardly from the firebox 56 to provide an exit route for the gases and products of combustion in the furnace. One or more fans 62 facilitate movement of the exhaust gases through exit duct 60 into the cleanup section C.

The cleanup section C includes a water reservoir 64 having a sump pump 66 mounted therein and a conduit 68 extending upwardly therefrom through which water from the reservoir 64 is delivered to be distributed as described hereinafter. The water in the reservoir is provided with a surfactant additive which makes the water wetter to the coal particles as will be described hereinafter. The surfactant may be any wetting agent which when placed in contact with coal particles, inhibits the normal tendency of coal to stick to surfaces it engages and to remain suspended in the water.

A primary filter box 70 includes an inlet 69 from conduit 60 through which the contaminated exhaust gases are introduced, as well as having the water conduit 68 extending up through a central portion thereof. In the primary filter box 70, a plurality of screens 80 are mounted diagonally beneath a return pan 82, which in turn includes a plurality of perforations in the bottom thereof. The entering air stream from conduit 60 passes through the screens 80, which are in effect merely carriers for water which is sprayed thereon to provide a water film. Passage of the air through the water film serves to initially separate coal particles and noxious gases from the exhaust air. A secondary tower 72 extends upwardly from primary filter box 70 and has the lower end thereof in communication with an opening 71 in the upper end of filter box 70 which provides for passage of the exhaust gases therethrough into the upper tower 72. An exit vent 74 is provided at the extreme upper end of the secondary filter tower 72 for deliverance of the cleaned exhaust to the atmosphere. Water conduit 68 is provided with a plurality of perforations up the length thereof, so that when pump 66 is on, water is continuously sprayed into the confines of the secondary water tower through the openings 76. A plurality of diagonally mounted screens 78 provide additional carriers onto which the water impinges to form other water film filters through which the air passes on its way to the exit 74. While the air path from the furnace section B passes through the primary filter box 70 and upwardly through the tower 72, the water forming the water film or water filter drops from the secondary tower into pan 82, and through the perforations 83 therein onto the screens 80 in the primary filter box 70. A dirty water conduit 84 carries the dirty cleaning solution from filter box 70 into a water cleaning box 86. A plurality of marble chips are provided in the box 86 through which the water settles by gravity. The marble chip filter performs a dual function of separating the solid contaminants from the dirty water, as well as forming a sulfur dioxide gas which may be collected by a dome (not shown) over the marble chip filter and returned into the furnace for reburning, thus increasing the efficiency of the system. The cleaned water returns to the reservoir 64 by means of a return conduit 90 from which it is recirculated.

Figure 4:
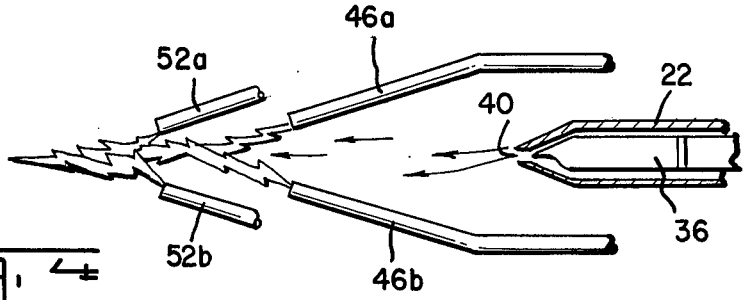
Figure 5:
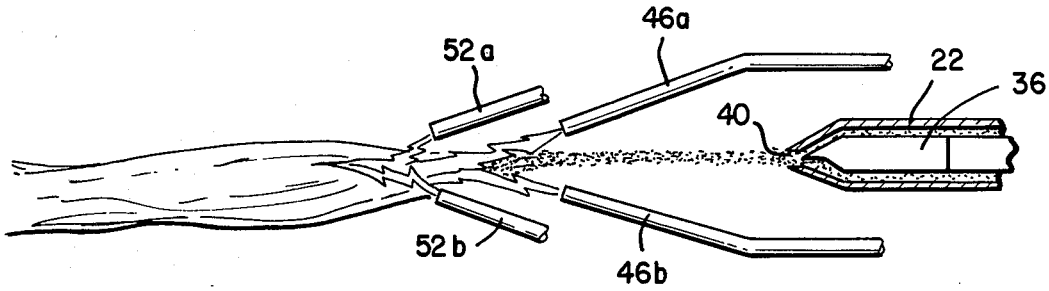

Turning now to FIGS. 3–5 there is illustrated in sequential schematic form the manner in which the electrodes of the electric arc igniter operate to provide a combustion zone of increased temperature to the extent that the electric arc electrodes alone will ignite and maintain combustion of the coal particles exiting from the exit end 40 of the nozzle. When utilizing two sets of electrodes, an arcing problem between the wrong electrodes can occur if all the electrodes are positioned at the same axial position. Therefore the electrodes are preferably arranged as illustrated. First of all, the first set of electrodes 46*a*, 46*b* are spaced downstream from the exit ends 40 of the feed tube 22. The second set of electrodes 52*a*, 52*b* are spaced slightly further downstream from the exit end 40 of the feed tube 22 than are the first set of electrodes 46*a*, 46*b*. Under normal conditions with no air exiting from feed tube 22, a first arc occurs across the electrodes 46*a*, 46*b* and a second arc occurs across the electrodes 52*a*, 52*b*. Moving now to FIG. 4, when air is forced through the feed tube 22 as does occur when the mixture of coal and air is being provided, the first arc, being closer to the exit end 40 is affected to a greater extent by the air. Therefore, the arc will bend downstream to a point where it merges with the arc between the second set of electrodes 52*a*, 52*b*. The second arc will not bend as much because it is further away from the exit end of the nozzle. By adjusting the distance between the two electrodes and between the electrodes and the exit end 40, the arcs can be merged together as illustrated in FIG. 4, with the result that the coal particles will ignite when introduced into the combustion zone of greater temperature as illustrated in FIG. 5.

In operation, coal is first pulverized in a grinder or pulverizer 10 and introduced into the hopper 12. The coal is then fed into the mixing chamber 14 where it becomes entrained with air and withdrawn by feed tube 22 and concentrated in the combustion zone in a pencil-lead-thin stream as described hereinabove. The temperature of the burner flame can be adjusted by the control sleeve or cover 28 to feed more or less fuel mixture as desired. It has been found that the results of the system to this point provide a very clean flame, which surprisingly is as clean as the flame from oil or natural gas burners. There is little or no residue at all remaining in the furnace, and certainly no ashes or clinkers. The result is that substantially 100% of the coal burns which has heretofore been unknown. To ensure complete clean up of the exhaust gases of combustion, the exhaust gases are routed through the cleaning system C where they are introduced to a series of water filters. The water which is sprayed onto a series of screens 78,80, forming a water filter is provided with a surfactant additive that causes the coal particles to become entrained into the water mixture, rather than impinging on and sticking to the surfaces of the screens and walls of the filter box 70 and the tower 72. The water is then routed to a clean up station 86 where the contaminants are removed from the water and it is returned to the reservoir to be reused.

It is felt that the above system is quite a unique approach and a remarkable improvement over other coal fired furnaces, and should provide quite a boost to the coal industry, as well as relieving the substantial amount of natural gas and oil now being consumed in furnaces and boilers. Industry has been looking for a way to utilize coal, and it is felt that the above described system overcomes all the problems with coal furnaces and boilers to the extent that they can now replace furnaces utilizing natural gas and oil.

While a preferred embodiment of the invention has been described in detail hereinabove it is apparent that various changes and modifications might be made without departing from the scope of the invention which is set forth in the claims below.

What is claimed is:

1. Powdered coal burning system in which solid powdered coal particles of a size up to 6 microns are utilized as the primary fuel in a furnace, said system comprising:

(a) a mixing chamber having a first inlet for receiving said powdered coal particles, a second inlet for receiving air flow with which the powdered coal particles are to be mixed, and an agitator means in said mixing chamber, in addition to said air flow, for effecting and maintaining a substantially homogenous mixture of air and powdered coal particles;

(b) a furnace chamber including a burner nozzle therein, said burner nozzle including igniting means for lighting said coal particles in said mixture as they exit from said nozzle;

(c) a feed means for adjustably withdrawing selected portions of said mixture of air and powdered coal particles from said mixing chamber and delivering said mixture to said nozzle; and (d) whereby said powdered coal particles are first mixed with the air to form a cloud of coal powdered entrained in air, then said cloud is conveyed to said nozzle and ignited to burn in said furnace.

2. The burning system according to claim 1 wherein said feed means includes a tube extending through said mixing chamber and having an input for compressed air at one end thereof, a slot in the wall of said tube within said mixing chamber, and a rotating wiper within said tube, whereby said compressed air passing through said tube draws in the mixture of air and coal through said slot into said tube for delivery to the other end thereof.

3. The burning system according to claim 2 and further including a control means for said feed means for varying the amount of the mixture of coal and air taken in through said slot.

4. The feed system according to claim 3 wherein said control means includes a slidable cover over said slot, and means for adjusting the position of said cover back and forth said slot to expose varying portions of said slot, whereby the amount of coal and air mixture drawn in may be selectively controlled.

5. The burning system according to claim 1 wherein said igniting means consists solely of an electric arc means.

6. The burning system according to claim 1 and further including an exhaust gas cleaning means downstream of said furnace chamber for cleaning the contaminating gases and particles from the exhaust gases of combustion from said furnace, said cleaning means comprising a plurality of sequentially arranged liquid filters through which said exhaust gases pass, said liquid filters each comprising a wire mesh member and means for spraying a supply of liquid on said wire mesh members.

7. The burning system according to claim 4 wherein said cleaning means further includes a liquid filter system for removing the collected contaminating particles and gases from the liquid after running off said screens.

8. The burning system according to claim 7 wherein said filter system includes a pit of marbel chips into which said contaminated liquid is delivered.

9. A process for efficiently burning coal particles through a nozzle comprising the steps of:

(a) pulverizing said coal particles to a size in the range where substantially all of said particles are less than six microns in size;

(b) mixing said pulverized coal particles with air to form a cloud having an homogenous mixture of coal particles entrained in air;

(c) feeding prescribed and controlled amounts of said cloud to a burner nozzle;

(d) concentrating the flow of particles from said nozzle to a combustion zone which is maintained at a temperature above the combustion temperature of said coal particles.

10. The process according to claim 9 wherein the step of maintaining said combustion zone at a temperature above the combustion temperature of said coal particles includes the formation of an electric arc substantially in the temperature of 1200 to 2400 degrees F.

11. The process according to claim 9 wherein the exhaust gases form by the burning of said coal particles through said nozzle are introduced to a water filter to clean the exhaust gases of whatever particles and noxious gases remain.

12. Apparatus for igniting solid powdered coal particles substantially all of which are of a size less than 6 microns comprising:

(a) a nozzle means through which a mixture of said powdered coal particles and air are delivered to an igniting zone;

(b) at least one set of electrodes spaced axially from the end of said nozzle on opposite sides of the path of air and coal as they exit from said nozzle;

(c) a transformer connected to said set of electrodes for selectively providing an arc therebetween;

(d) said transformer and electrodes being so selected that said arc is in the temperature of 1200 to 2400 degrees F.;

(e) said nozzle means converging at the exit end thereof to concentrate said coal particles into a stream of coal particles and air which are introduced to the combustion zone formed at the arc.

13. Apparatus according to claim 12 wherein there are provided two sets of electrodes so arranged with respect to each that the arcs therebetween converge at a single combustion zone, said electrodes so arranged with respect to each other that the combustion zone formed by the merging of the arcs thereof is of a size at least equal to the cross section diameter of the stream of coal particles and air emitted from said nozzle.

14. The apparatus according to claim 13 wherein said electrodes are so arranged that one set thereof are spaced downstream from the other set thereof and on opposite sides of the path of air and coal, said two sets of electrodes being so arranged axially along said path of air and coal exiting from said nozzle with respect to each other and with respect to said nozzle that the air pressure leaving said nozzle causes the arc between the first set of electrodes to bend downstream and substantially merge with the arc between said second set of electrodes, thereby maximizing the temperature of the zone into which the powdered coal particles are delivered above the combustion point.

* * * * *